US008870212B2

(12) United States Patent
Noyes et al.

(10) Patent No.: US 8,870,212 B2
(45) Date of Patent: Oct. 28, 2014

(54) ELECTROMAGNETICALLY LOCKABLE ROTATING BINDING FOR A SPORTBOARD OR THE LIKE

(75) Inventors: Chris M. Noyes, Virginia Beach, VA (US); Amanda Story, Hampton, VA (US)

(73) Assignee: Noyes Britt Bouche, Inc., Chesapeake, VA (US)

( * ) Notice: Subject to any disclaimer, the term of this patent is extended or adjusted under 35 U.S.C. 154(b) by 176 days.

(21) Appl. No.: 13/571,437

(22) Filed: Aug. 10, 2012

(65) Prior Publication Data

US 2014/0042728 A1 Feb. 13, 2014

(51) Int. Cl.
*A63C 9/00* (2012.01)

(52) U.S. Cl.
USPC ..... 280/612; 280/618

(58) Field of Classification Search
CPC ..... A63C 10/18
USPC ..... 280/306, 11.14, 11.15, 11.3–11.36, 280/607, 612, 613
See application file for complete search history.

(56) References Cited

U.S. PATENT DOCUMENTS 3,361,775 A 1/1968 Tidd
RE33,544 E 2/1991 Dennis
5,354,088 A * 10/1994 Vetter et al. ..... 280/618
5,362,087 A * 11/1994 Agid ..... 280/611
5,553,883 A * 9/1996 Erb ..... 280/607
5,577,755 A * 11/1996 Metzger et al. ..... 280/607
5,586,779 A * 12/1996 Dawes et al. ..... 280/14.24
5,667,237 A * 9/1997 Lauer ..... 280/607
5,732,959 A * 3/1998 Soejima ..... 280/14.24
5,762,358 A * 6/1998 Hale ..... 280/607
5,765,853 A * 6/1998 Erb ..... 280/607
5,772,221 A * 6/1998 Daley ..... 280/11.204
5,791,678 A * 8/1998 Perlman ..... 280/618
5,820,155 A 10/1998 Brisco
5,876,045 A * 3/1999 Acuna, Jr. ..... 280/14.24
5,947,488 A * 9/1999 Gorza et al. ..... 280/14.21
5,954,357 A 9/1999 Rolling
5,984,325 A * 11/1999 Acuna ..... 280/14.24
6,022,040 A * 2/2000 Buzbee ..... 280/613
6,022,041 A * 2/2000 Dailey et al. ..... 280/618
6,062,584 A * 5/2000 Sabol ..... 280/607
6,065,768 A * 5/2000 Lee ..... 280/613
6,102,430 A * 8/2000 Reynolds ..... 280/618
6,155,578 A * 12/2000 Patterson ..... 280/14.24
6,155,591 A * 12/2000 Huffman et al. ..... 280/618
6,196,569 B1 * 3/2001 Berger et al. ..... 280/607
6,203,051 B1 * 3/2001 Sabol ..... 280/607

(Continued)

*Primary Examiner* — Hau Phan
*Assistant Examiner* — Jacob Meyer
(74) *Attorney, Agent, or Firm* — Neifeld IP Law, PC

(57) ABSTRACT

An apparatus for facilitation selective rotation of a sportboard binding relative to a sportboard interposed between the binding and the sportboard. An electro-magnetically actuated locking mechanism controls the rotation of a retaining ring assembly relative to a bottom capture plate and a top plate assembly. The bottom capture plate is attached to the sportboard. The retaining ring assembly is attached to the binding by teeth on an outer perimeter thereof. One or more pairs of diametrically opposed ferromagnetic inserts placed in the retaining ring assembly define specific angular positions at which the binding may be locked. An external power source (e.g., a battery) is connected to the electro-magnetically actuated locking mechanism via a switch adapted to be operated by a rider of the sportboard such that the rider can selectively control the locking and unlocking of the mechanism to allow rotation of the binding as desired.

11 Claims, 3 Drawing Sheets

(56) References Cited

U.S. PATENT DOCUMENTS

| | | | | |
|---|---|---|---|---|
| 6,290,243 | B1 * | 9/2001 | Beran | 280/14.24 |
| 6,299,192 | B1 | 10/2001 | Bryce | |
| 6,302,411 | B1 * | 10/2001 | Huffman et al. | 280/14.24 |
| 6,318,749 | B1 * | 11/2001 | Eglitis et al. | 280/607 |
| 6,331,007 | B1 * | 12/2001 | Bryce | 280/11.3 |
| 6,491,310 | B1 * | 12/2002 | Work | 280/14.24 |
| 6,575,489 | B1 * | 6/2003 | White | 280/613 |
| 6,855,023 | B2 * | 2/2005 | Berger et al. | 441/70 |
| 6,905,133 | B2 * | 6/2005 | Lett | 280/618 |
| 6,910,706 | B2 * | 6/2005 | Holzer et al. | 280/618 |
| 6,910,707 | B1 * | 6/2005 | Lyng | 280/618 |
| 6,945,837 | B2 * | 9/2005 | Crumrine et al. | 441/70 |
| 6,994,370 | B2 * | 2/2006 | Sabol | 280/618 |
| 7,090,228 | B2 * | 8/2006 | Reynolds | 280/14.24 |
| 7,168,710 | B1 * | 1/2007 | Hennebry | 280/14.24 |
| 7,222,864 | B2 | 5/2007 | Giering, Jr. | |
| 7,270,337 | B1 * | 9/2007 | Carotenuto | 280/14.24 |
| 7,281,717 | B2 * | 10/2007 | Sacco et al. | 280/14.22 |
| 7,290,785 | B2 * | 11/2007 | Dixon | 280/617 |
| 7,300,070 | B2 * | 11/2007 | Pelchat | 280/617 |
| 7,320,191 | B2 | 1/2008 | Trinkaus et al. | |
| 7,334,810 | B2 * | 2/2008 | Holzer et al. | 280/618 |
| 7,384,048 | B2 * | 6/2008 | Cerrito | 280/14.22 |
| 7,416,191 | B2 * | 8/2008 | Yoshino | 280/14.22 |
| 7,571,924 | B2 * | 8/2009 | White | 280/618 |
| 7,658,398 | B2 * | 2/2010 | Panzeri | 280/618 |
| 7,815,214 | B2 * | 10/2010 | Sabol | 280/618 |
| 7,837,219 | B1 * | 11/2010 | Cordes | 280/618 |
| 7,918,477 | B2 * | 4/2011 | Wischhusen et al. | 280/618 |
| 8,052,157 | B2 * | 11/2011 | Holzer | 280/14.24 |
| 8,276,921 | B2 * | 10/2012 | Walker | 280/14.24 |
| 8,371,591 | B2 * | 2/2013 | Hwongbo | 280/14.24 |
| 8,596,668 | B2 * | 12/2013 | Van Bregmann, Jr. | 280/618 |
| 2003/0094788 | A1 * | 5/2003 | Jacobs | 280/612 |
| 2003/0230870 | A1 * | 12/2003 | Sabol | 280/618 |
| 2006/0197310 | A1 * | 9/2006 | Fletcher | 280/607 |
| 2006/0273550 | A1 * | 12/2006 | Delago | 280/607 |
| 2010/0109289 | A1 * | 5/2010 | Wischhusen et al. | 280/613 |
| 2011/0057420 | A1 * | 3/2011 | Walker | 280/624 |
| 2012/0025490 | A1 * | 2/2012 | Van Bregmann, Jr. | 280/607 |
| 2012/0161412 | A1 * | 6/2012 | Majerik | 280/124.106 |
| 2012/0211969 | A1 * | 8/2012 | Walker | 280/623 |

* cited by examiner

ELECTROMAGNETICALLY LOCKABLE ROTATING BINDING FOR A SPORTBOARD OR THE LIKE

FIELD OF THE INVENTION

The invention pertains to a binding rotation mechanism and, more particularly, to an electromechanical, selectively engaged binding rotation mechanism for use on snowboards, skateboards, wakeboards, sandboards and the like.

BACKGROUND OF THE INVENTION

The modern downhill sport of snowboarding has its roots in the mid-1960's, when an engineer invented a toy for his daughter. Over the years, snowboarding has evolved into a very popular winter sport. In 1998 snowboarding was added as a Winter Olympic sport.

Downhill skiing uses separate skis and boot/binding systems for each foot, allowing independent maneuvering of each foot, boot, and ski. In contrast to that, snowboarding equipment consists of one common board on which are mounted the bindings for both of the rider's feet.

Snowboard boot bindings are usually fastened to the snowboard in a permanent, static orientation. Typically they are oriented at an angle of between 45 and 90 degrees to the longitudinal axis of the snowboard. In some cases the angle may approach 0 degrees to accommodate specific riding styles. For example, freestyle riding may have near 0 degree or negative rear foot angles. Higher angles are deemed more appropriate for carving, also known as alpine snowboarding.

A particular binding orientation is chosen to provide the rider with the ideal control and comfort for the sport of downhill snowboarding, and more particularly, the riding style of choice. However, it may not be the ideal orientation for approaching a chairlift, loading and unloading from a lift, or for local maneuvering at the top and bottom of the ski slope. In these situations, snowboarders may remove one boot, usually the rearward boot, from its binding to maneuver and propel themselves where the slope does not provide gravitational momentum. With one boot attached to the binding at a 45 to 90 degree angle to the longitudinal axis of the snowboard, the process of pushing the board and rider with the free foot/boot is awkward and uncomfortable at best, and the snowboarder may be prone to injury or accident. Dismounting from a chairlift is probably the most potentially awkward situation. The rider must negotiate a dismount while propelled by the chairlift, and then must move out of the way of the chairlift and subsequent passengers before the next chair approaches the dismount point.

While it is common for snowboard bindings to be secured to the snowboard at a fixed location and static angular orientation, some bindings can be rotated to different angular orientations by removing the boot from the binding and using tools to rotate the binding relative to the longitudinal axis of the snowboard. Other bindings may be rotated and locked in another angular orientation without removing the boot from the binding or using a tool. Additionally, some riding styles, skill levels, or preferences may benefit from a binding rotation mechanism that can remain unlocked at the rider's choice, allowing the free rotation of the binding.

Several similar types of sporting activities exist that may also use sideways-standing stances in combination with binding rotation mechanisms, including skateboarding, wakeboarding and sandboarding.

DISCUSSION OF THE RELATED ART

Many attempts have been made to overcome the deficiencies found in binding systems of the prior art. For example, U.S. Pat. No. RE33,544 for RELEASABLE BINDING SYSTEM FOR SNOWBOARDING issued Feb. 26, 1991 to David Dennis discloses a binding system comprising releasable toe and heel clips where by the release of one boot from the ski board automatically causes the release of the other boot, to reduce or prevent the risk of injury to the rider in the event of an out-of-control event or fall.

U.S. Pat. No. 3,361,775 for PHOTOCOMPOSING APPARATUS AND METHOD FOR VARYING CHARACTER MAGNIFICATION issued Jan. 4, 1972 to James A. Tidd discloses an apparatus for indexing a turret having multiple lenses mounted, selecting a desired lens, and locking the turret in position using a solenoid and plunger arrangement, biased outwardly by a coil spring. In order to index to another lens, the solenoid is activated to retract the plunger and unlock the turret.

U.S. Pat. No. 5,362,087 for SNOWBOARD BINDING RELEASE APPARATUS issued Nov. 8, 1994 to Troy Agid discloses a latch and release mechanism for securing latch members of binding straps for both feet to the latch and release mechanism mounted on a snowboard. The disclosed latch and release mechanism provides for either mechanical or electrical release of the binding latches. The mechanical means to release the latches is accomplished through flexible cable connected to the latch mechanism. The embodiment for electrical release is accomplished using either a control switch connected to a solenoid in the latch mechanism via wire, or through the use of a radio transmitter and receiver combination to actuate the latch solenoid.

U.S. Pat. No. 5,820,155 for STEP-IN BINDING SYSTEM FOR RETRO-FITTING TO A SNOWBOARD BOOT BINDER issued Oct. 13, 1998 to Don L. Brisco discloses a step-in, quick-release binding system that can be retrofitted to an existing snowboard. The binding system includes a manual quick-release mechanism and an electro-mechanical quick-release mechanism that is operated by a radio frequency (RF) transmitter and receiver pair.

U.S. Pat. No. 5,954,357 for APPARATUS FOR GLIDING OVER SNOW issued Sep. 21, 1999 to Eugene J. Rolling discloses a snow boot and binding system that utilizes only magnetic forces to affix the boot to the binding. The disclosure includes a mechanism to facilitate the quick release of the snow boot from the upper surface of the snowboard.

U.S. Pat. No. 6,155,578 for BINDING MOUNT issued Dec. 5, 2000 to Patrick J. Patterson describes a mount for securing a boot binding to a snowboard that permits the binding to be easily rotated between the user-preferred angular orientation for snowboarding that is pre set by the binding, to an orientation approximately parallel to the longitudinal axis of the snowboard, and back to the original pre-set snowboarding orientation as desired by the rider.

U.S. Pat. No. 6,299,192 for SPORTING EQUIPMENT BINDING APPARATUS issued Oct. 9, 2001 to Jonathan Bryce describes a mechanical binding apparatus for engaging an article of footwear with a piece of sports equipment. In one embodiment, the engagement is accomplished mechanically with a compression ring situated within the sole of a shoe that engages with a dome shaped knob situated on sports equipment, such as a skateboard or surfboard. Another embodiment provides for magnetically engaging a dome shaped knob on a piece of sports equipment using a rare earth magnet in cooperation with the dome shaped knob, and a metal plate in a receiving opening placed in the sole of the sport shoe.

U.S. Pat. No. 7,222,864 for APPARATUS AND METHOD FOR DETERMINING THE CORRECT STANCE FOR RIDERS OF BOARD-TYPE TITLE CONVEYANCES issued May 29, 2007 to George Giering Jr. describes an adjustable apparatus that is used to determine an appropriate custom fit stance for the individual rider of a board-type conveyance. The apparatus is used to evaluate the proper stance width and angle of the front and rear feet to the longitudinal axis of the board-type conveyance. Subsequently, the bindings can be custom-mounted at the stance width and foot angles determined using the apparatus, for the rider's maximum comfort and riding style.

U.S. Pat. No. 7,320,191 for SPORTS SHOE, IN PARTICULAR A SKI SHOE issued Jan. 22, 2008 to Gerhard Trinkaus et al, describes several embodiments of a mechanism that provides the means to adjust the angle between the cuff part and the shell part of a ski shoe, thereby adjusting the angle between the ankle and lower legs of the rider and the longitudinal axis of the skis. The various embodiments of the adjustment mechanism can be operated by means of a wireless remote control having a signal transmitter module, which may be incorporated in a watch, mobile telephone, PDA, or special purpose transmitter device.

None of the patents and published patent applications, taken singly, or in any combination are seen to teach or suggest the novel binding rotation mechanism of the present invention.

SUMMARY OF THE INVENTION

In accordance with the present invention there is provided a binding rotation mechanism intended and designed for use with a variety of boards for use in several sports. Although not restricted to these sports, typically the inventive binding rotation mechanism may be used for sports where both feet are secured to a single board or board-like device using sport shoes or boots, and bindings. Examples of these sports include, but are not limited to snowboarding, skateboarding, wakeboarding, and sandboarding.

The present invention provides a mechanism for allowing the board rider to rotate the position of one or both bindings relative to the longitudinal axis of the board for the purpose of adjusting a rider's stance, either while in motion or while stationary. This ability may be desirable for moving to a more comfortable stance, allowing for a change in riding style or purpose, or to facilitate a trick or exhibition as part of a competition or performance. The inventive binding rotation mechanism can be rotated fully through one or more 360 degree revolutions, as desired by the rider while an electromagnet in the binding rotation mechanism is deactivated, but can also be held in one of a choice of two or more locked positions when the electromagnet is activated under the control of the rider.

The binding rotation mechanism comprises a bottom capture plate and a top flange assembly that bolt directly to a sportboard, in a fashion consistent with, and familiar to those skilled in the art of attaching bindings to snowboards skateboards, wakeboards, sandboards and the like. Sandwiched between the bottom capture plate and the top flange assembly is situated a retaining ring having a gear tooth pattern that locks into the binding hardware. Between the retaining ring, and both the bottom capture plate and the top flange assembly are placed ball bearings, held in ball bearing grooves (i.e., chases), that allow the free rotation of the retaining ring and the binding hardware relative to the other components, as well as the sportboard to which they are fastened. With this mechanical arrangement, the retaining ring and the bindings can rotate freely with respect to the top flange, bottom capture plate, and the sportboard. An electromagnet is disposed within the top flange assembly that is connected to a power source through a rider operated switch. Iron inserts are installed in diametrically opposed pairs at predetermined locations around the inner surface of the retaining ring. When engaged, the electromagnet cooperates with the closest pair of iron inserts to lock the retaining ring in a desired angular position relative to the top flange, selectively preventing rotation of the retaining ring. At least one additional pair of iron inserts disposed at 180 degrees from one another is located such that another locked angular position may be chosen by the rider. Additional pairs of iron inserts can be added to provide a plurality of predetermined angular locking positions.

It is, therefore, an object of the invention to provide a sportboard binding that may be rotated relative to the major axis of the sportboard.

It is another object of the invention to provide a sportboard binding that may be rotated relative to the major axis of the sportboard wherein the binding is held in a desired angular position by a catch mechanism.

It is an additional object of the invention to provide a sportboard binding that may be rotated relative to the major axis of the sportboard wherein the catch mechanism is electromagnetically actuated.

It is a further object of the invention to provide a sportboard binding that may be rotated relative to the major axis of the sportboard wherein the electromagnetically actuated catch is controlled by a switch actuatable by the rider of the sportboard.

It is yet another object of the invention to provide a sportboard binding that may be rotated relative to the major axis of the sportboard wherein the rider may selectively actuate the catch mechanism while the sportboard is either stationery or in motion.

It is a still further object of the invention to provide a sportboard binding that may be rotated relative to the major axis of the sportboard wherein a plurality of predetermined detent positions may selectively be provided.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention relates to binding rotation mechanisms that allow selective rotation of the bindings on a board-type sporting conveyance such as a snowboard, skateboard, wakeboard, sandboard, and the like. For simplicity, the term "sportboard" is used hereinafter to refer to any such board device. One or both sportboard bindings may selectively rotate and then be locked in one of a plurality of predetermined angular orientations to the major axis of a sportboard. The rotation and locking may be accomplished without requiring removal of either the rider's boots or the sportboard binding. The selective locking and unlocking is accomplished electromagnetically using a control actuated by the rider of the sportboard.

Figure 1:
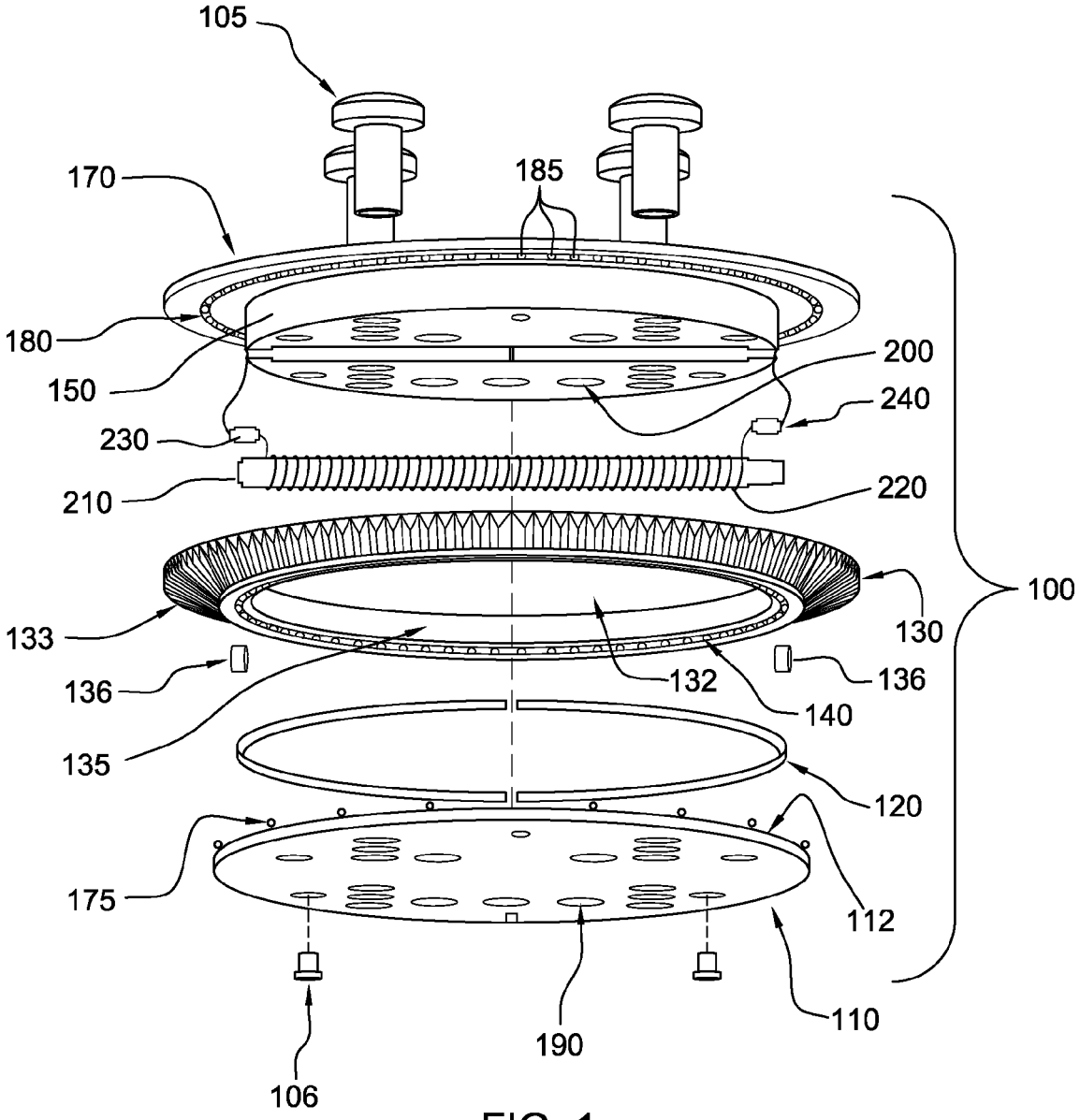
FIG. 1 is an exploded, side, perspective, schematic view of the binding rotation mechanism in accordance with the invention.

Referring first to FIG. 1, there is shown an exploded, side perspective, schematic view of the binding rotation mechanism in accordance with the invention, generally at reference number 100.

Binding rotation mechanism 100 has a bottom capture plate 110 and a top plate assembly 150 held together by threaded fasteners 106, typically flat head screws received in and retained by bottom holes in top plate assembly 150. In still other embodiments, threaded fasteners may be replaced with rivets, structural adhesives, or alternate methods to secure the top plate assembly 150 to the bottom capture plate 110.

Bottom capture plate 110 provides a supporting base for the other components of the binding rotation mechanism 100. Bottom capture plate 110 has a plurality of holes 190 formed therein. Holes 190 may be provided in multiple patterns that match industry standard patterns provided on standard sportboards for mounting bindings to the sportboard.

Top plate assembly 150 is circular and includes a circular flange cover portion 170 proximate an upper surface thereof. A second ball bearing chase 180 is disposed on or in a lower surface of flange cover 170. A second set of ball bearings 185 is disposed in second ball bearing chase 180. Top plate assembly 150 including flange cover portion 170 has a second act of fastening holes 200 therein. Second set of holes 200 are typically identical to first set of holes 190 in bottom capture plate 110 such that when top plate assembly 150 is fastened to bottom capture plate 110 by flat head screws 106, retaining ring 130 is free to rotate supported by first and second sets of ball bearings 175, 185, respectively.

The remainder of the binding rotation mechanism 100 is sandwiched between bottom capture plate 110 and top plate assembly 150.

A circular retaining ring 130 having a first ball bearing chase 140 circumferentially positioned in the bottom surface 132 thereof is disposed above bottom capture plate 110. A first set of ball bearings 175 disposed in first ball bearing chase 140 allows retaining ring 130 to rotate freely on bottom capture plate 110 unless otherwise constrained as is described in more detail hereinbelow.

Figure 5:
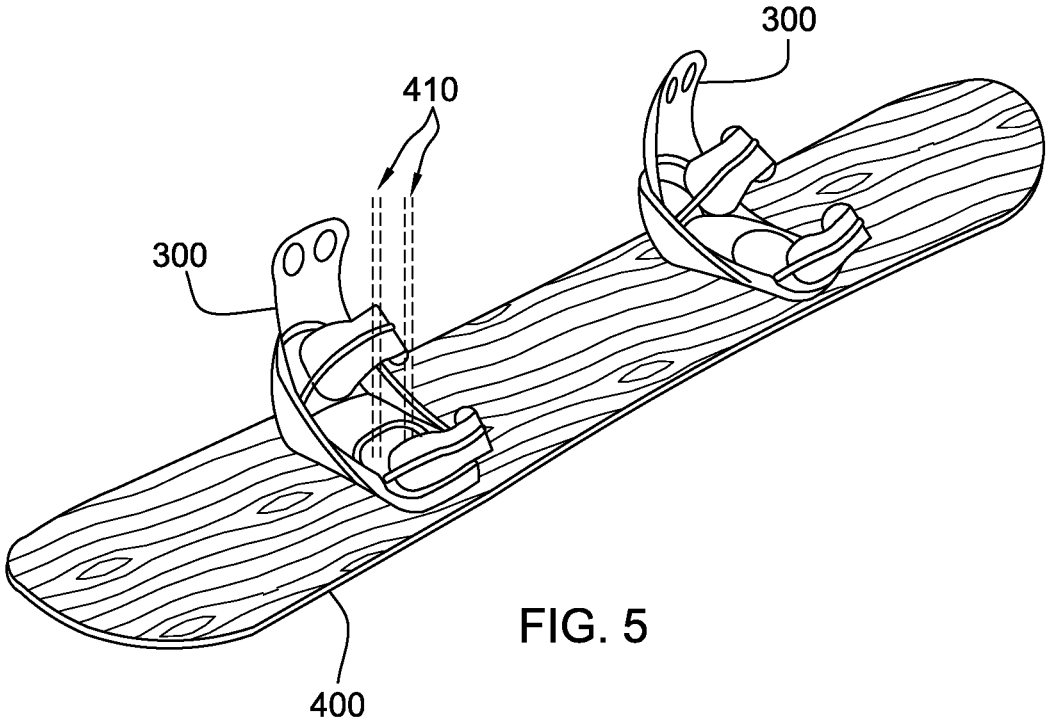

Circular retaining ring 130 incorporates teeth 133 disposed on the entire outer perimeter thereof. Teeth 133 are sized and configured to interact (i.e., engage) with teeth, not shown, disposed in the base of a binding 300 (FIG. 5).

An electromagnet 210 is a cylindrical, ferromagnetic structure with a winding 220 wrapped therearound. Electromagnet 210 is disposed within a section of the top plate assembly 150. Winding 220 may be energized to lock the retaining ring 130 into a desired position relative to the top plate assembly 150 and bottom capture plate 110.

One or more pairs of metal inserts 136 are diametrically disposed around the circumference of inside surface 135 of the retaining ring 130. When electromagnet 210 is engaged, it is attracted to the nearest pair of metal inserts 136 so as to lock the binding rotation mechanism 100 in a specific angular orientation. Preselected angular positions at which the bindings 300 may be locked are created by appropriate placement of a pair of metal inserts 136. Metal inserts are typically formed from iron or another suitable material. It will be recognized by people of skill in the art that numerous ferromagnetic materials are available that may be substituted for the iron material chosen for purposes of disclosure. Consequently, the invention is not considered limited to a particular ferromagnetic material but encompasses all suitable ferromagnetic materials.

An electrically conductive ring 120, typically formed from copper, is attached to retaining ring 130. Conductive ring 120 has an electrical interruption 125 therein, best seen in FIG. 2. Electrical interruption 125 may be implemented as a physical break in conductive ring 120.

Figure 2:
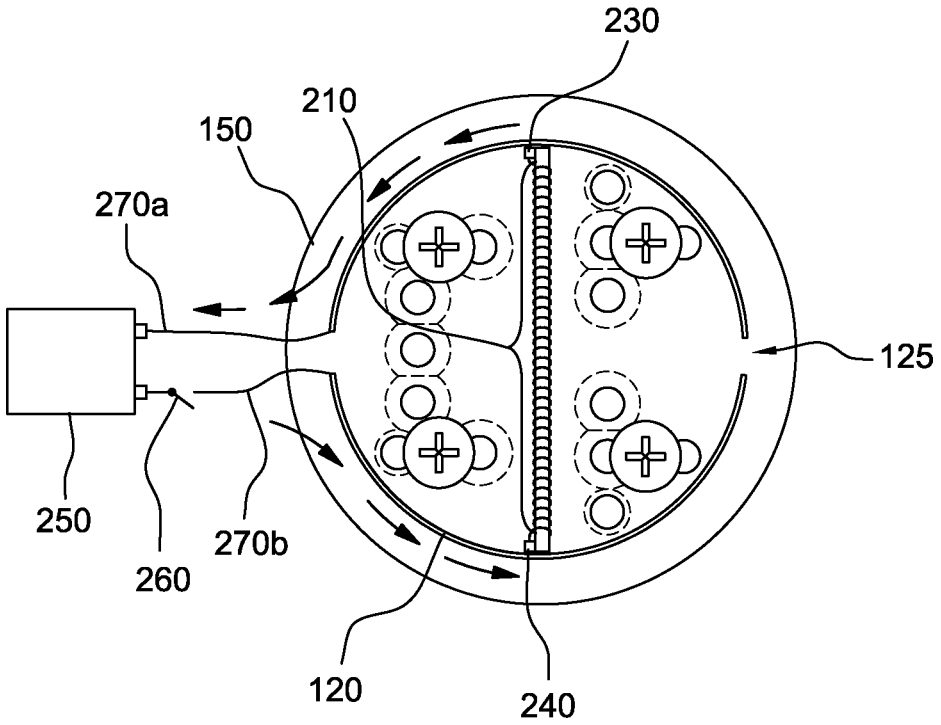
FIG. 2 is a schematic diagram of an electrical circuit for engaging the electromagnet of the binding rotation mechanism of FIG. 1.

Referring now also to FIG. 2, there is shown a schematic diagram of an electrical circuit for engaging the electromagnet 210 of the binding rotation mechanism of FIG. 1. Opposite ends of winding 220 terminate in a first conductive contact 230 and a second conductive contact 240. First and second electrical contacts 230, 240, respectively, are stationary within top plate assembly 150 and adapted to slide against conductive ring 120 as it rotates in conjunction with retaining ring 130 to which it is affixed whereby electrical power may selectively be delivered to electromagnet 210.

An electrical power source (e.g., a battery or other portable source of DC power) 250 is connected to opposite ends of conductive ring 120 by electrical conductors (e.g., wires) 270*a*, 270*b*. Electrical conductor 270*b* has an electrical switch 260 inserted therein. Electrical switch 260 selectively allows current from power source 250 to selectively energize electromagnet 210. In operation, electrical switch is typically operated by a rider of sportboard 400 (FIG. 5).

Figure 3:
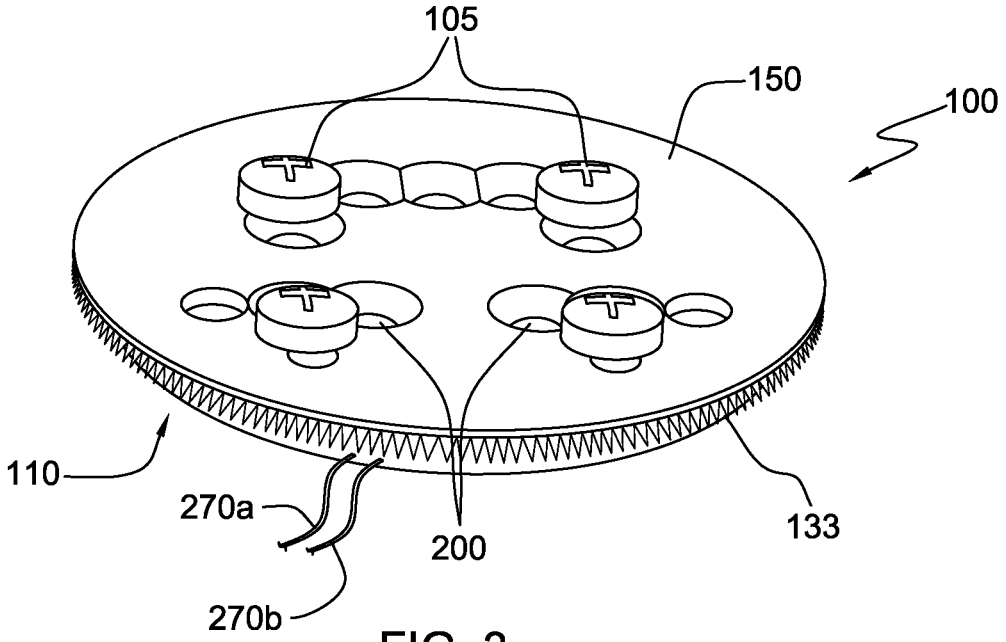
FIG. 3 is a front perspective, schematic view of an assembled binding rotation mechanism.

Referring now also to FIG. 3, there is shown a side, perspective, schematic view of completely assembled binding rotation mechanism 100. Electrical conductors (i.e., power leads) 270*a*, 270*b* may be seen extending from an edge of binding rotation mechanism 100. Further, those of skill in the art will recognize that electrical conductors 270*a*, 270*b* might benefit from being attached to binding rotation mechanism 100 by an electrical connector, not shown, that would allow selective attachment and detachment of electrical conductors 270*a*, 270*b*, power source 250 and electrical switch 260 to and from binding rotation mechanism 100 as desired. Typically a locking connector may be chosen to ensure inadvertent disconnection of electrical conductors 270*a*, 270*b* from binding rotation mechanism 100 while riding sportboard 400.

Mounting holes 200 allow fastening binding rotation mechanism 100 to binding 300 and sportboard 400 (FIG. 5) using fasteners and techniques deemed to be well known to those of skill in the art. Such fasteners form no part of the instant invention.

It will be recognized by those of skill in the fastening arts that other devices, systems, or methods may be substituted for those disclosed herein. Consequently the invention is not considered limited for the devices and/or arrangements chosen for purposes of disclosure but includes all other possible fastening devices and arrangements.

Figure 4:
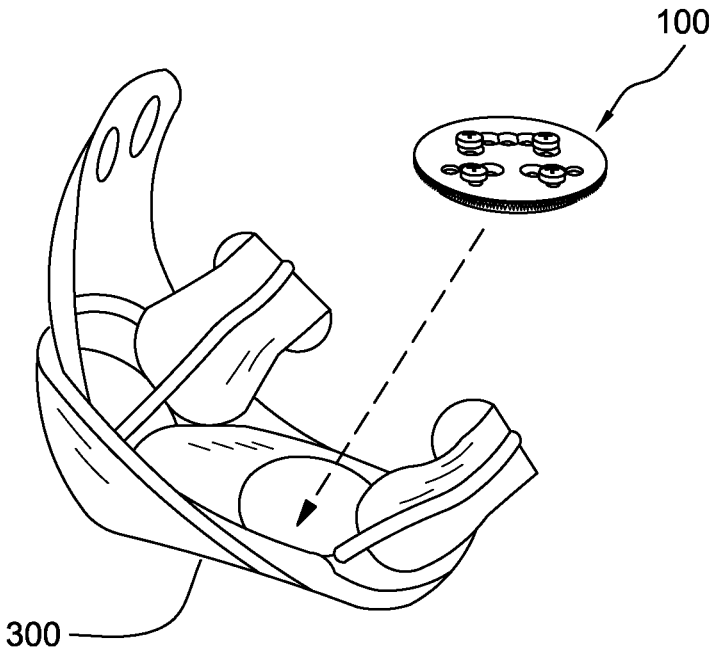
FIG. 4 is a front perspective view illustrating the location of the binding rotation mechanism in the base of a sportboard binding and FIG. 5 is a side perspective view illustrating location of fasteners for attaching the binding rotation mechanism and bindings to a sportboard.

Referring now also to FIG. 4, there is shown a side perspective schematic view of a binding 300 having a location in its base for receiving a binding rotation mechanism 100 poised for insertion therein.

Referring now also to FIG. 5, there is shown a sportboard 400, which may be a snowboard, skateboard, wakeboard, sandboard, or the like, showing the approximate location 410 for fastening the binding 300 to the sportboard 400 using said first fastening holes 190 (FIG. 1) and second fastening holes 200 (FIG. 1).

In operation, the sportboard rider may choose to turn the switch 260 off, allowing free rotation of the bindings 300 relative to the sportboard 400. Alternatively, the sportboard rider may choose to turn on the switch 260 to activate the electromagnet 210, which will engage with the nearest pair of metal inserts 136 to lock the bindings using magnetic attraction between the electromagnet 210 and metal inserts 136. The sportboard rider may choose one of several specific predetermined angular orientations at which to lock the bindings.

Since other modifications and changes varied to fit particular operating requirements and environments will be apparent to those skilled in the art, the invention is not considered limited to the example chosen for purpose of disclosure, and covers all changes and modifications which do not constitute departures from the true spirit and scope of this invention.

Having thus described the invention, what is desired to be protected by Letters Patent is presented in the subsequently appended claims.

What is claimed is:

1. An apparatus for facilitating selective rotation of a binding with respect to a surface of a sportboard, comprising:

a bottom capture plate having fastening holes therethrough and arranged in a pattern, said bottom capture plate adapted for attachment to a sportboard;

a top plate assembly having fastening holes therethrough arranged in an identical pattern to that of said pattern in said bottom capture plate, said top plate assembly disposed above said bottom capture plate and fixedly connected thereto, said top plate assembly being aligned with said bottom capture plate such that said fastening hole pattern therein is aligned with said identical fastening hole pattern in said bottom capture plate;

a retaining ring assembly sandwiched between said bottom capture plate and said top plate assembly and separated from each thereof by ball bearings allowing rotation of said retaining ring assembly relative to said bottom capture plate and said top plate assembly;

a locking mechanism for selectively locking said retaining ring assembly relative to said bottom capture plate and said top plate assembly, thereby preventing rotation of said retaining ring assembly relative to said bottom capture plate and said top plate assembly when said locking mechanism is engaged;

wherein said locking mechanism comprises an electrically actuated locking mechanism;

wherein said electrically actuated locking mechanism compromises:

an electromagnet disposed in said top plate assembly; and at least one pair of diametrically opposed ferromagnetic inserts selectively disposed around a perimeter of an interior region of said retaining ring assembly.

2. The apparatus for facilitating selective rotation of a binding with respect to a surface of a sportboard as recited in claim 1, wherein each of said at least one pair of diametrically opposed ferromagnetic inserts defines a particular angular position at which said retaining ring assembly may be locked relative to said top plate assembly and said bottom capture plate.

3. The apparatus for facilitating selective rotation of a binding with respect to a surface of a sportboard as recited in claim 1, further comprising:

an electrical switch disposed externally to said apparatus for facilitating selective rotation of a binding and electrically connected to said electromagnet and to a source of electrical power, said electrical switch operable by a rider of a sportboard to which said apparatus for facilitating selective rotation of a binding is attached.

4. The apparatus for facilitating selective rotation of a binding with respect to a surface of a sportboard as recited in claim 3, wherein when said electromagnet is energized, said retaining ring assembly is locked to said top plate assembly and said bottom capture plate and wherein when said electromagnet is deenergized, said retaining ring assembly is free to rotate relative to said top plate assembly and said bottom capture plate.

5. The apparatus for facilitating selective rotation of a binding with respect to a surface of a sportboard as recited in claim 2, wherein said electromagnet comprises a ferromagnetic core having a winding therearound, said winding having a first end terminating in a first conductive contact disposed adjacent a first end of said electromagnet and a second end terminating in a second conductive contact adjacent an opposite end of said electromagnet.

6. The apparatus for facilitating selective rotation of a binding with respect to a surface of a sportboard as recited in claim 5 wherein said ferromagnetic core comprises an iron core.

7. The apparatus for facilitating selective rotation of a binding with respect to a surface of a sportboard as recited in claim 5, further comprising:

an electrically conductive ring operably attached to said retaining ring assembly and disposed to be in wiping contact with said first conductive contact and said second conductive contact, said electrically conductive ring having a first end connected to a first connection of an electrical power source and a second end connected to a second connection of an electrical power source, said electrically conductive ring having an electrically non-conducting region at approximately a midpoint thereof, said electrically conductive ring and said first and second conductive contacts functioning as a brush assembly to supply electrical power to said winding of said electromagnet as said top plate assembly and said bottom capture plate move relative to said retaining ring assembly.

8. A method of allowing selective rotation of a binding with respect to a surface of a sportboard, the steps comprising:

providing an apparatus comprising a bottom capture plate, a top plate assembly and a retaining ring assembly disposed therebetween and isolated from each of said bottom capture plate and said top plate assembly by a set of interposed ball bearings, said apparatus comprising an electromagnetically actuated locking assembly;

attaching said apparatus to an upper surface of a sportboard using fasteners passing through mounting holes provided in both said top plate assembly and said bottom capture plate, a lower surface of said bottom capture plate contacting said upper surface of said sportboard;

attaching a conventional sportboard binding to said apparatus, by engaging teeth in said conventional sportboard binding with compatible teeth disposed on an outer perimeter of said retaining ring assembly; and energizing said electromagnetically actuated locking assembly thereby locking said binding in a particular angular relationship to said sportboard.

9. The method of allowing selective rotation of a binding with respect to a surface of a sportboard as recited in claim 8, the steps further comprising:

deenergizing said electromagnetically actuated locking assembly thereby allowing rotation of said retaining ring assembly and said conventional sportboard binding fixedly attached thereto.

10. The method of allowing selective rotation of a binding with respect to a surface of a sportboard as recited in claim 8, wherein said providing an apparatus step comprises the sub-step:

providing at least one pair of diametrically opposed ferromagnetic inserts in a perimeter of said retaining ring assembly, each of said at least one pair of diametrically opposed ferromagnetic inserts defining an angular position whereat said retaining ring assembly may be locked relative to said bottom capture plate and said top plate assembly.

11. The method of allowing selective rotation of a binding with respect to a surface of a sportboard as recited in claim 10, wherein said providing an apparatus step further comprises the sub-step:

providing an electrical power source connected to said electromagnetically actuated locking assembly and an intervening electrical switch disposed for operation by a rider of said sportboard whereby said rider may selectively energize and deenergize said electromagnetically actuated locking assembly thereby controlling the locking and unlocking of said conventional sportboard binding and thereby controlling the rotation of said conventional sportboard binding relative to said sportboard to which it is attached.

* * * * *